US007447451B2

(12) United States Patent
Funabiki

(10) Patent No.: US 7,447,451 B2
(45) Date of Patent: Nov. 4, 2008

(54) IMAGE PRINTING APPARATUS WITH FIXING DEVICE

(75) Inventor: Hiroshi Funabiki, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 359 days.

(21) Appl. No.: 11/361,225

(22) Filed: Feb. 24, 2006

(65) Prior Publication Data

US 2006/0251433 A1 Nov. 9, 2006

(30) Foreign Application Priority Data

May 9, 2005 (JP) ..... 2005-135936

(51) Int. Cl.
*G03G 15/20* (2006.01)

(52) U.S. Cl. ..... 399/45; 399/68

(58) Field of Classification Search ..... 399/45, 399/68, 67, 82

See application file for complete search history.

(56) References Cited

U.S. PATENT DOCUMENTS 4,723,146 A * 2/1988 Kasahara ..... 399/82
5,073,801 A * 12/1991 Haneda et al. ..... 399/45
5,075,732 A * 12/1991 Menjo ..... 399/45
5,111,248 A * 5/1992 Kita et al.
6,909,857 B2 * 6/2005 Tanaka ..... 399/45

FOREIGN PATENT DOCUMENTS

| | | | |
|---|---|---|---|
| EP | 899630 | A1 * | 3/1999 |
| JP | 5-62011 | | 3/1993 |
| JP | 5-344329 | | 12/1993 |
| JP | 5-344330 | | 12/1993 |
| JP | 7-30752 | | 1/1995 |
| JP | 8-146797 | | 6/1996 |
| JP | 8-251403 | | 9/1996 |
| JP | 2002-49264 | | 2/2002 |
| JP | 2003-46771 | | 2/2003 |

* cited by examiner

*Primary Examiner*—Susan S Lee
(74) *Attorney, Agent, or Firm*—Cantor Colburn LLP

(57) ABSTRACT

An image printing apparatus may include a fixing device, a first image printing mode where the recording medium comes into contact with the fixing member at substantially the same position during continuous fixing operation, and a second image printing mode where the recording medium comes into contact with the fixing member with a shorter time interval than in the first image printing mode.

24 Claims, 6 Drawing Sheets

IMAGE PRINTING APPARATUS WITH FIXING DEVICE

CROSS-REFERENCE TO RELATED APPLICATION

This application makes reference to, incorporation the same herein, and claims all benefits accruing under 35 U.S.C. § 119 from an application for Image Printing Apparatus earlier filed in the Japanese Patent Office on May 9, 2005, and there duly assigned No. 2005-135936.

BACKGROUND OF THE INVENTION

1. Field of the Invention

The present invention relates to an electro-photographic image printing apparatus such as a copying machine, printer, or facsimile machine and, more particularly, to a fixing section employed in the image printing apparatus.

2. Description of the Related Art

Generally, in an electrophotographic image printing apparatus, a charging means, exposing means, and developing means are arranged around an image carrier. Charging, exposure, and development are performed to form a toner image on the image carrier. The toner image is transferred onto a recording medium to form an unfixed toner image. A fixing means is widely used in which the unfixed toner image on the recording medium is sandwiched and conveyed by a heat roller and a pressure roller in tight contact with the heat roller so as to fix the toner image.

In such a fixing section, when the length in the convey direction of the recording medium is larger than the circumferential length of the heat roller, after the leading edge in the convey direction of the recording medium comes into contact with the heat roller, the recording medium is sandwiched and conveyed by the rotating heat roller and rotating pressure roller. The heat roller that rotates for the second turn comes into contact again with the trailing edge of the recording medium which is still in contact with the heat roller (which has not passed through the nip portion yet). This trailing edge of the recording medium is called an overlapping portion.

The heat roller at the overlapping portion is deprived of heat while it is in contact with the recording medium, and the heat roller temperature accordingly becomes lower than a normal fixing temperature. This causes problems such as so-called under-fixing in which fixing is not performed completely and so-called reverse surface soiling in which the unfixed toner on the heat roller is transferred to the pressure roller to soil the reverse surface of the recording medium. Even if such an extreme inconvenience does not occur, the gloss of the overlapping portion becomes lower than that of a leading portion of the overlapping portion to form a clear boundary between the overlapping and leading portions that appears as a difference in gloss to degrade the image quality.

In order to solve the above problems, a method is proposed in which the circumferential length of the heat roller is set be equal to the sum of the length of the recording medium and the interval length between the current and next recording media, or an integer multiple of the sum (for example, see Japanese Unexamined Patent Publication No. 8-146797 as patent reference 1).

Another method is also proposed in which the circumferential length of the fixing member is set to be equal to or larger than the length in the convey direction of a standard size recording medium which is used most frequently, or equal to or larger than the length of the short side of the standard size recording medium (for example, see Japanese Unexamined Patent Publication No. 2002-49264 as patent reference 2).

With the methods described in patent references 1 and 2, a gloss difference formed between the leading and trailing edges of the recording medium may be solved. When, however, the recording medium to be employed is mainly of A6 size or B5 size with a length in the convey direction of 150 mm to 180 mm, in spite that the recording medium has a short length, since the process speed of the image printing apparatus is based on the sum of the standard size recording medium and the paper interval length as a reference, the printing productivity degrades greatly. In case of an A3-size recording medium, a gloss difference occurs at the boundary of an overlapping portion and a non-overlapping region, and in the worst case, an under-fixing error or the like occurs at the overlapping portion.

SUMMARY

The present invention may provide an image printing apparatus with which when plain paper is used, the printing productivity will not be impaired, and when coated paper having high gloss (to be referred to as high-gloss coated paper) which is used in a color printer or the like and is formed by applying a coating material onto the surface of a recording medium is used, the fixing gloss does not degrade.

According to a first aspect of the present invention, an image printing apparatus, may comprise a fixing device which heats and fixes an unfixed toner image on a recording medium while sandwiching and conveying the recording medium by a heat member and a pressure member; a first image printing mode where the recording medium comes into contact with said heat member at substantially the same position during continuous fixing operation; and a second image printing mode where the recording medium comes into contact with said fixing member with a shorter time interval than in the first image printing mode.

According to second aspect of the present invention, an image printing apparatus may comprise: a fixing device which heats and fixes an unfixed toner image on a recording medium while sandwiching and conveying the recording medium by a heat member and a pressure member, said heat member having a circumferential length larger than a length of a maximum-size recording medium; a first image printing mode where the recording medium comes into contact with said heat member at substantially the same position during continuous fixing operation; a second image printing mode where the recoding medium comes into contact with said heat member with a shorter time interval than in the first image recording mode; and a switching device to switch the first image printing mode and the second image printing mode.

According to third aspect of the present invention, an image printing apparatus may comprise: a fixing device which heats and fixes an unfixed toner image on a recording medium while sandwiching and conveying the recording medium by a heat member and a pressure member; a first image printing mode where each recording medium comes into contact with said heat member at substantially the same position each turn of the heat member during continuous fixing operation; and a second image printing mode where each recording medium comes into contact with said heat member at different positions between a turn and next turn of the heating member during continuous fixing operation.

The present invention is more specifically described in the following paragraphs by reference to the drawings attached only by way of example.

BRIEF DESCRIPTION OF THE DRAWINGS

A more complete appreciation of the present invention, and many of the attendants advantages thereof, will become ready apparent as the same becomes better understood by reference to the following detailed description when considered in conjunction with the accompanying drawings in which like reference symbols and reference numerals indicate the same or similar components, wherein.

DETAILED DESCRIPTION OF THE PREFERRED EMBODIMENTS

Some preferred embodiments of the present invention will be described below with reference to the accompanying drawings. Note that the description of the preferred embodiments does not limit the technical scope of the claims or the meanings of the technical terms. The following assertive explanation concerning the embodiments of the present invention shows the best mode and does not limit the meanings of the technical terms or the technical scope of the present invention.

Regarding an image printing apparatus which includes a fixing section according to the present invention, first, its schematic arrangement will be described with reference to FIG. 1. The fixing section according to the present invention will be described with reference to FIGS. 2A and 2B.

Figure 1:
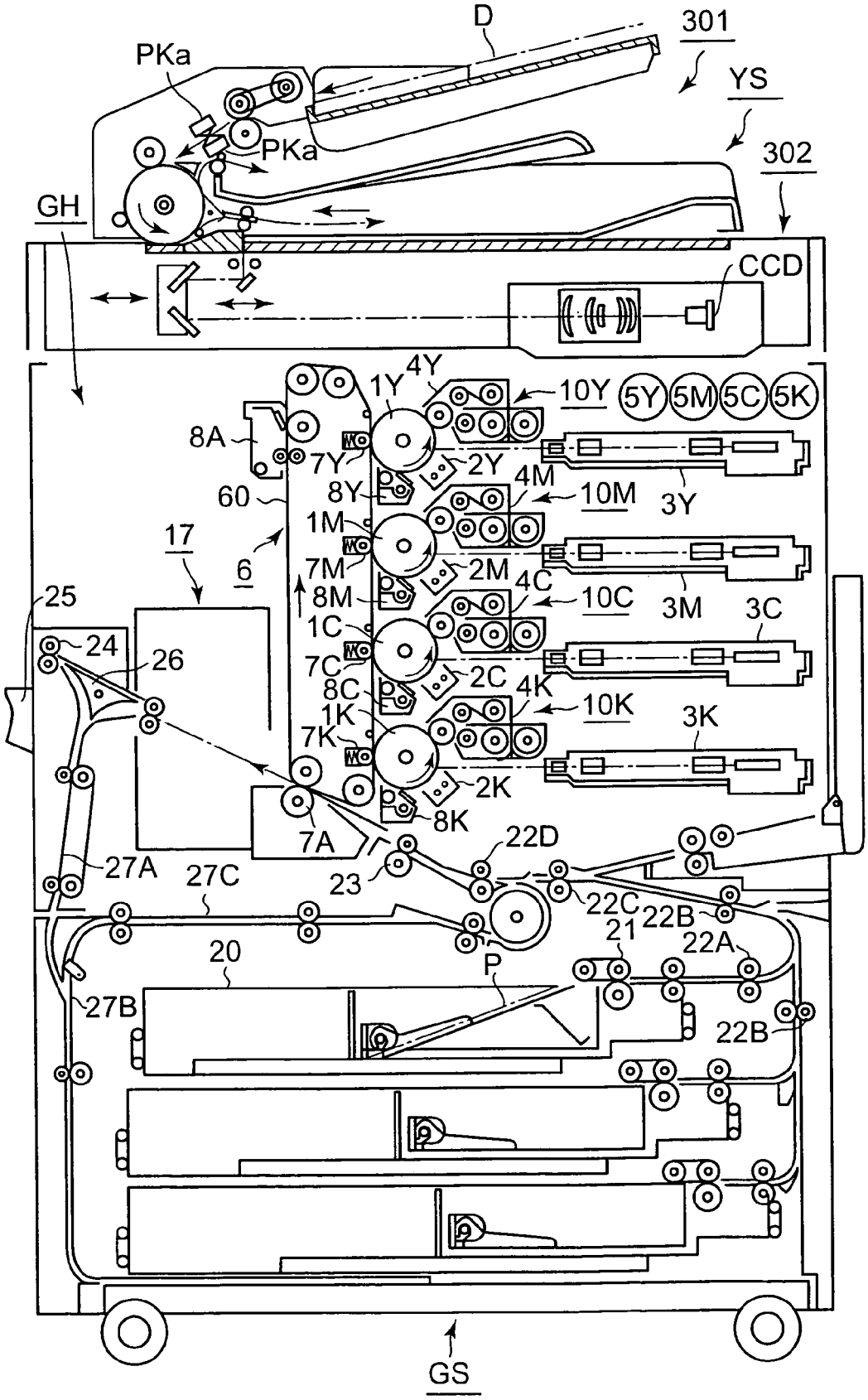
FIG. 1 is a schematic sectional view showing the arrangement of an image printing apparatus which includes a fixing section according to the present invention.

Referring to FIG. 1, an image printing apparatus GS comprises an image printing apparatus main body GH and image reading device YS.

The image printing apparatus main body GH, which is referred to as a tandem color image printing apparatus, comprises a plurality of image printing units 10Y, 10M, 10C and 10K, an intermediate transfer body unit 6, a fixing device 17 described later and a sheet feed and conveying section 21.

The image reading device YS comprising an automatic document feeder 301 and document image scanning/exposing device 302 is set on the image printing apparatus main body GH. A document D placed on the document table of the automatic document feeder 301 is conveyed by a convey portion. The image on one surface or the images on the two surfaces of the document are scanned and exposed by the optical system of the document image scanning/exposing device 302 and read by a line image sensor CCD. In this case, the gloss degree of the document image, whether the document image is a monochrome or color image, and whether the document D has images on its two surfaces are discriminated by a gloss level detection sensor PKa used as a gloss level selector.

An analog signal obtained by photoelectric conversion of the line image sensor CCD is subjected to an analog process, A/D conversion, shading correction, image compression, and the like by an image processor, temporarily stored in a memory, and sent in the form of signals to image write units (image exposure units) 3Y, 3M, 3C, and 3K.

The image printing unit 10Y for printing yellow (Y) color images has a photosensitive drum 1Y as an image carrying body, a Y-color charging section 2Y arranged around the photosensitive drum 1Y, an image exposure section 3Y, a developing section 4Y, and a cleaning section 8Y. The image printing unit 10M for printing magenta (M) color images has a photosensitive drum 1M, a M-color charging section 2M arranged around the photosensitive drum 1M, an image exposure section 3M, a developing section 4M, and a cleaning section 8M. The image printing unit 10C for printing cyan (C) color images has a photosensitive drum 1M, a C-color charging section 2C arranged around the photosensitive drum 1C, an image exposure section 3C, a developing section 4C, and a cleaning section 8C. The image printing unit 10K for printing black (K) color images has a photosensitive drum 1K, a K-color charging section 2K arranged around the photosensitive drum 1K, an image exposure section 3K, a developing section 4K, and a cleaning section 8K. Each of respective pairs of: the charging section 2Y and the image exposure section 3Y; the charging section 2M and the image exposure section 3M; the charging section 2C and the image exposure section 3C; and the charging section 2K and the image exposure section 3K forms a latent image forming section.

The developing sections 4Y, 4M, 4C, and 4K are developing devices which contain, respectively, two-composition developing agent consisting of toner of a small particle and carrier for yellow (Y) color, magenta (M) color, cyan (C) color, and black (K) color.

The intermediate transfer body unit 6 has a semi-conducting, endless-belt-like intermediate transfer body 60 which is wound around and rotatably mounted on a plurality of rollers.

The images of the respective colors formed by image printing units 10Y, 10M, 10C, and 10K are sequentially transferred onto an intermediate transfer body 60 pivoted by transfer rollers 7Y, 7M, 7C, and 7K to form a composite color image (primary transfer). A recording medium P as a transfer medium accommodated in a feed cassette 20 is fed by a feed portion 21 and conveyed to transfer rollers 7A via feed rollers 22A, 22B, and 22C, registration rollers 23, and the like, so that the color image is transferred onto the recording medium P (secondary transfer). After the color image is transferred onto the recording medium P, an auxiliary nip portion Na (see FIG. 2A; not shown in FIG. 1) formed in a fixing device 17 and located before the fixing section and a main nip portion Nb (see FIG. 2A; not shown in FIG. 1) formed in the fixing device 17 sandwich the recording medium P and apply heat and pressure to it to fix the color toner image (or toner image) on it. The recording medium P is then sandwiched by delivery rollers 24 on the delivery path and placed on a delivery tray 25 outside the printing press.

In performing a duplex image printing, color images (color toner images) are formed on one side surface of the recording medium P, and the recording medium P discharged from the fixing device 17 is deviated from the sheet-discharging path by a branching section 26. The recording medium P then passes through a lower cyclical sheet-passing path 27A and is reversed by passing through a reverse sheet-conveying path 27B, which is a re-feed mechanism (ADU mechanism). Thereafter, the recording medium P passes through a re-feed sheet-conveying unit 27C and then merges into the sheet-discharging path at a feeding roller 22D. The recording medium P reversed and conveyed (cyclically reversed and conveyed) into the sheet-discharging path is further conveyed to the secondary transfer roller 7A again via the registration roller 23, where color images (color toner images) are transferred together to the other side surface (rear surface) of the recording medium P. The fixing device 17 performs to fix the color images transferred on the recording medium P. The recording medium P is then held tight by the discharging roller 24 and placed on the discharge tray 25 mounted outside the apparatus.

On the other hand, a cleaning section 8A removes residual toner on the intermediate transfer body 60, which is allowed to separate the recording medium P by curvature, after the transfer of the color images to the recording medium P using the secondary transfer roller 7A.

Two examples of the fixing device 17 according to the present invention will be described with reference to FIGS. 2A and 2B.

Figure 2A:
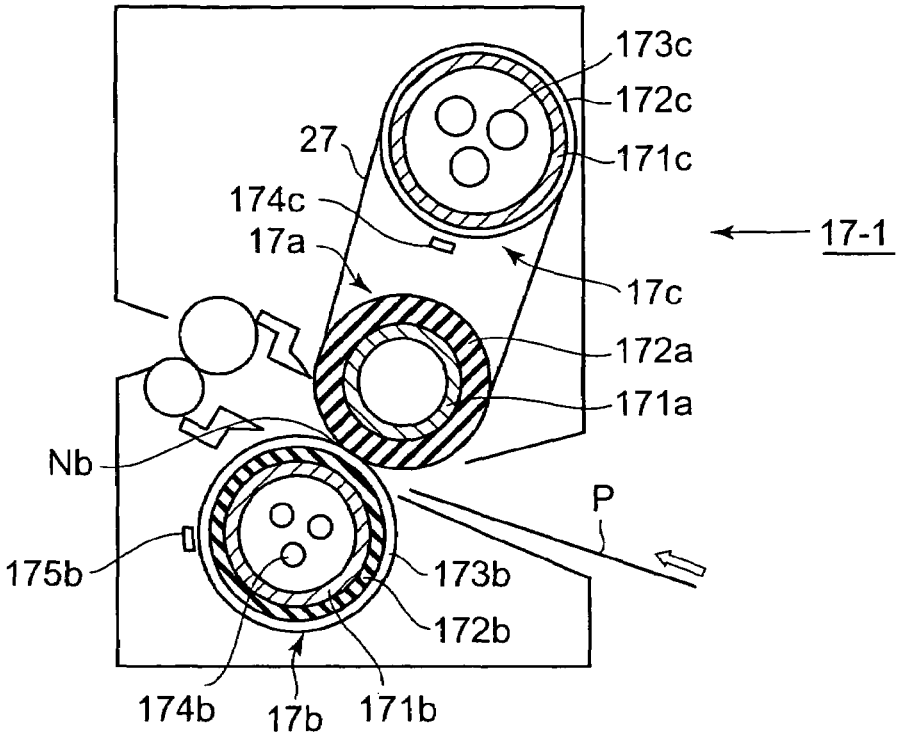
FIGS. 2A and 2B are schematic sectional views showing two different examples of the fixing section according to the present invention.

A fixing device 17-1 as the first example shown in FIG. 2A includes a fixing belt 27 formed of an endless belt member, a fixing roller 17*a* around which one side of the inner surface of the fixing belt 27 is supported and looped, a heat roller 17c around which the other side of the inner surface of the fixing belt 27 is supported and looped and which incorporates a heater 173*c*, and a pressure roller 17*b* which abuts against the fixing roller 17*a* through the fixing belt 27 to pressurize the fixing roller 17*a*. The fixing nip portion Nb is formed between the fixing roller 17*a* and pressure roller 17*b*. The recording medium P is heated and pressurized at the fixing nip portion Nb so the toner image formed on the recording medium P is fixed.

The pressurizing force of the pressure roller 17*b* which pressurizes the fixing roller 17*a* desirably falls within the range of 800 N to 1,200 N when considering the gloss after the transfer or curling of the transfer medium. At this time, the rotating shaft of the fixing roller 17*a* is fixed (does not move vertically), and a bonding release mechanism (not shown) is provided to the pressure roller 17*b*.

As the base of the fixing belt 27, a heat-resistant resin belt made of polyimide or the like having the following specifications is used:

| | |
|---|---|
| outer diameter: | about 150 mm to 170 mm |
| circumferential length: | 500 mm to 550 mm |
| width: | 350 mm to 400 mm |
| thickness: | 50 μm to 200 μm |

The outer (circumferential) surface of the base is covered with silicone rubber to a thickness of about 100 μm to 350 μm. A release layer having a thickness of about 30 μm to 50 μm and made of PFA (perfluoroalkoxy) or a fluorine-based resin is formed on the resultant surface, or a PFA tube covers the resultant surface, to form the fixing belt 27. To obtain good fixing properties and good heat response, the rubber hardness of the silicone rubber layer preferably falls within the range of 20° to 40° (JIS-A hardness tester).

As the base of the fixing roller 17*a*, a steel metal pipe 171a such as a STKM (a carbon steel pipe for a machine structural purpose) is used. A silicone rubber layer 172*a* having a thickness of 5 mm to 15 mm and hardness of 5° to 30° (JIS-A hardness tester) is formed on the outer surface of the metal pipe 171*a* to form the fixing roller 17*a* as a soft roller having an outer diameter of about 20 mm to 50 mm.

As the base of the pressure roller 17*b*, a metal pipe 171*b* made of a steel material such as a STKM (a carbon steel pipe for a machine structural purpose), or aluminum material is used. A silicone rubber layer 172*b* having a thickness of 1 mm to 3 mm is formed on the outer surface of the metal pipe 171*b*. Furthermore, a release layer 173*b* using a PFA (perfluoroalkoxy) tube having a thickness of about 20 μm to 50 μm is formed on the silicone rubber layer 172*b* to form the pressure roller 17*b* as a soft roller having an outer diameter of about 40 mm to 80 mm. The pressure roller 17*b* incorporates a pressure roller heater 174*b* including a halogen heater. The silicone rubber layer 172*b* has rubber hardness of 5° to 30° (JIS-A hardness tester). A pressure roller temperature sensor 175*b* is arranged in contact or noncontact with the pressure roller 17*b* so as to control the temperature of the pressure roller 17*b*.

The heat roller 17*c* includes a metal pipe 171*c* formed of, e.g., an aluminum material and having a thickness of about 1 mm to 5 mm, and a PFA (perfluoroalkoxy) coating 172*c* having a thickness of about 10 μm to 30 μm and formed on the outer surface of the metal pipe 171*c*, to form a roller member having an outer diameter of about 40 mm to 80 mm. The heat roller 17*c* incorporates the heat roller heater 173*c* including a halogen heater. A heat roller temperature sensor 174*c* is arranged in contact or noncontact with the heat roller 17*c* so as to control the temperature of the heat roller 17*c*.

Figure 2B:
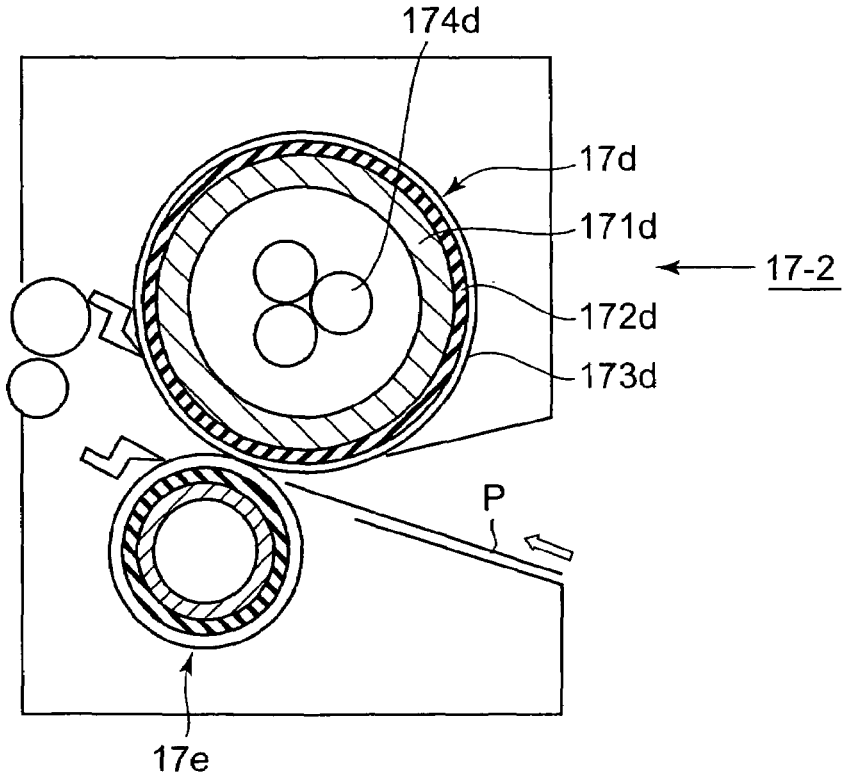

FIG. 2B shows a fixing device 17-2 as the second example which is different from the fixing device 17-1 of the belt fixing scheme described above. The fixing device 17-2 shown in FIG. 2B is of the roller fixing scheme which uses, in place of the fixing belt 27 of the first example, a cylindrical fixing heat roller 17*d* having a circumferential length larger than the length of the maximum-size recording medium.

The maximum size of the recording medium refers to the maximum size among recording medium sizes that are set as standard sizes in the printing apparatus. The recording medium size is determined based on the length in convey direction as a reference.

Referring to FIG. 2B, as the base of the fixing heat roller 17*d*, a cylindrical metal pipe 171*d* made of, e.g., an aluminum material and having a thickness of about 1 mm to 10 mm is used. A silicone rubber layer 172*d* having a thickness of 1 mm to 5 mm is formed on the outer surface of the metal pipe 171*d*, and a PFA (perfluoroalkoxy) coating 173*d* having a thickness of about 10 μm to 30 μm is formed on the outer surface of the silicone rubber layer 172*d* sequentially to form the fixing heat roller 17*d* as a roller member having an outer diameter of about 160 mm to 175 mm. The fixing heat roller 17*d* incorporates a heat source 174*d* including a halogen heater. A pressure roller 17*e* has the same structure as that of the pressure roller 17*b* of the first example.

Figure 3A:
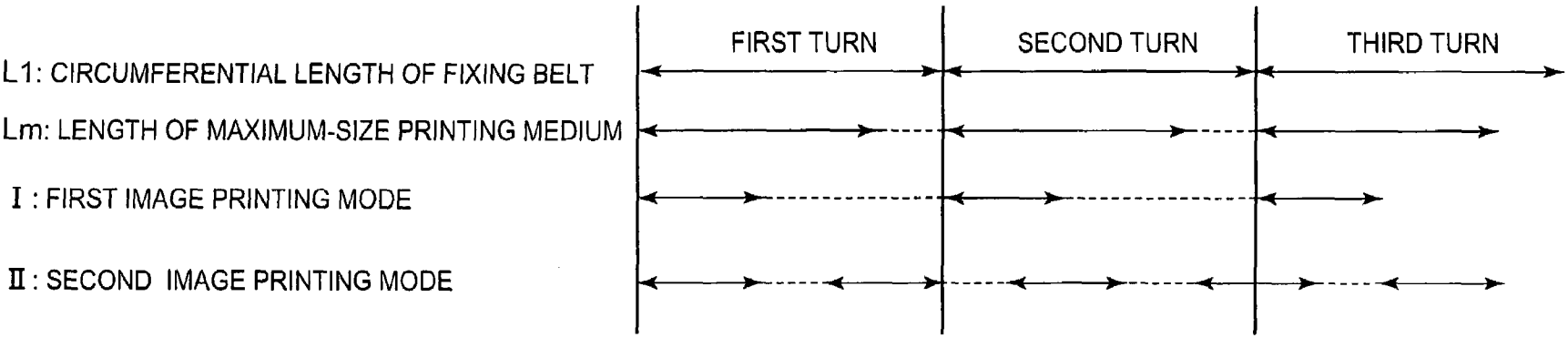
FIGS. 3A and 3B are charts showing the relationship between the circumferential length of a fixing belt 27 of the belt fixing scheme according to the present invention and the lengths in convey direction of two types of recording media, and the relationship between the circumferential length of a fixing roller of the conventional scheme and the length of a maximum-size recording medium, respectively.
Figure 3B:
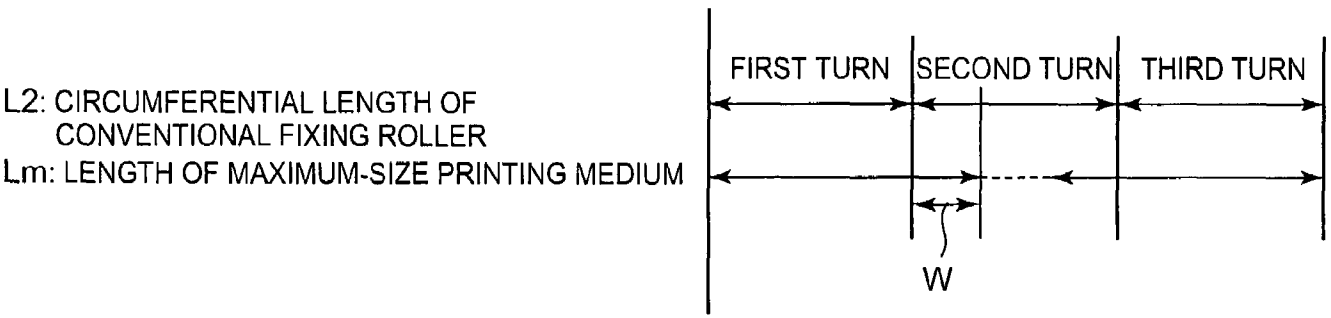

FIGS. 3A and 3B show the relationship between the circumferential length of the fixing belt 27 of the belt fixing scheme according to the present invention and the lengths in convey direction of two types of recording media, and the relationship between the circumferential length of the fixing roller of the conventional scheme and the length of the maximum-size recording medium, respectively.

As shown in FIG. 3A, when a circumferential length L1 of the fixing belt 27 is larger than a length Lm of a maximum-size recording medium, an overlapping portion W (see FIG. 3B) of the conventional scheme is eliminated, so that the amount of fixing heat to be deprived of can be decreased.

I in FIG. 3A shows a fixing example of the first image printing mode of the present invention. Fixing is performed with the circumferential length cycle of the fixing belt 27. Namely, the recording medium is brought into contact with the fixing belt 27 at an almost predetermined position. More specifically, one turn of the fixing belt 27 fixes one recording medium. Thus, no overlapping occurs, and a high-quality image with excellent gloss can be obtained. When two or more recording media including the distance between the recording media are to be present within the circumferential length of the fixing belt 27, one turn of the fixing belt 27 can fix two or more recording media.

When a high-quality recording medium such as high-gloss coated paper is to be used, even if the recording medium is a short-length sheet such as an A4-size sheet, the apparatus is switched to the first image printing mode to print with the circumferential length cycle of the fixing belt 27. In this case, although the printing productivity degrades, high-quality printing with high fixing gloss can be performed (see I in FIG. 3A).

II in FIG. 3A shows a fixing example of the second image printing mode of the present invention. Fixing is performed continuously without any non-fixing interval. Namely, printing media are sequentially fixed each with a length as the sum of the length of the recording medium and the distance between the recording media. More specifically, one turn of the fixing belt 27 can fix more than one recording medium. According to the second image printing mode, highly productive image printing can be performed efficiently.

With plain paper for which priority is given to the productivity rather than the quality, assume a case wherein A4-size recording media are to be printed continuously. In this case, according to the second image printing mode, the recording media are printed continuously, regardless of the rotation cycle of the fixing belt 27, with a length cycle as the sum of the length in the convey direction of an A4-size recording medium and the distance between the recording media. Thus, printing productivity is improved (see II in FIG. 3A).

As shown in FIG. 3B, if a circumferential length L2 of the fixing roller of the conventional scheme is smaller than the maximum-size recording medium length Lm, an overlapping portion W occurs in the printing cycle.

In a first image printing mode, each recording medium comes into contact with the heat member at substantially the same position each turn of the heat member during continuous fixing operation. And in a second image printing mode, each recording medium comes into contact with the heat member at different positions between a turn and next turn of the heating member during continuous fixing operation.

Figure 4:
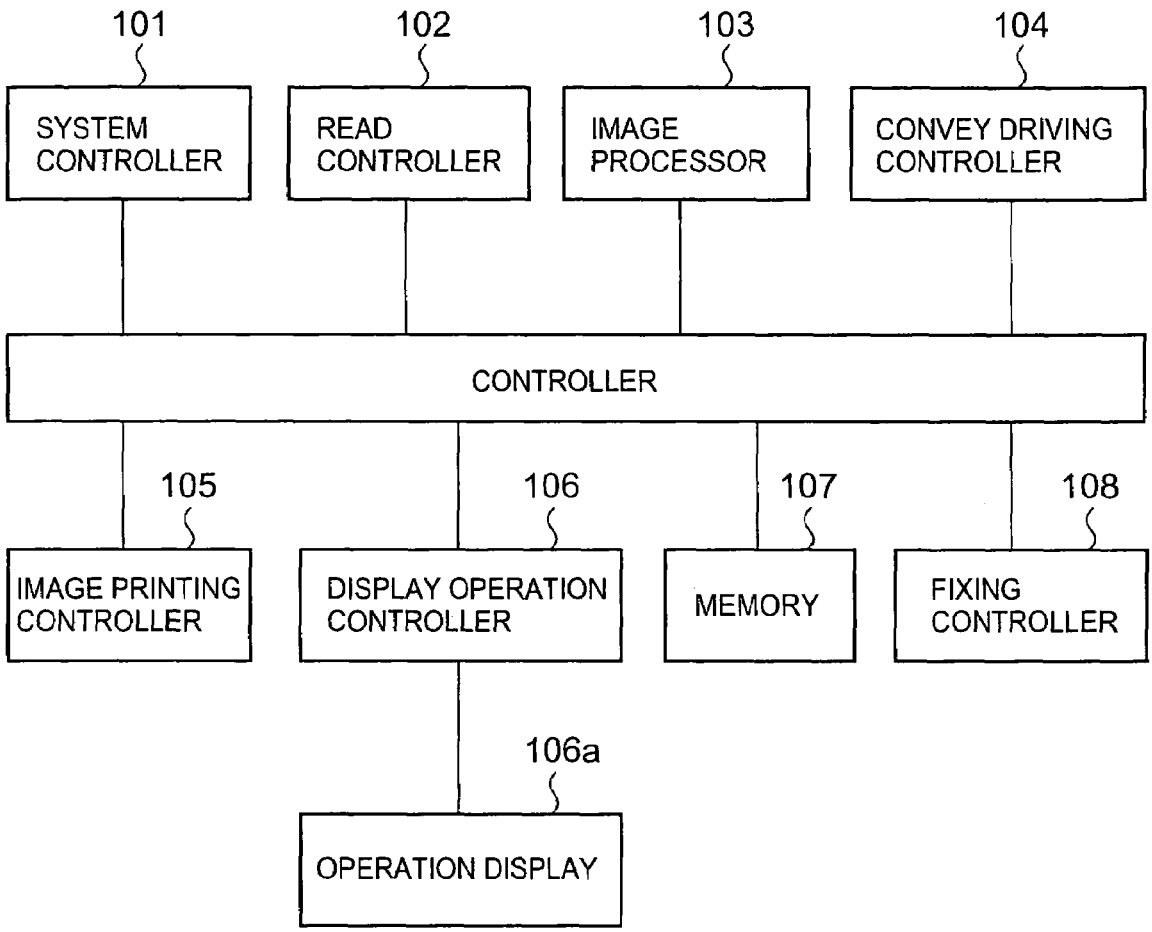
FIG. 4 is a block diagram showing the control system of the image printing apparatus according to the present invention.

The control system of the image printing apparatus according to the present invention will be described with reference to the block diagram of FIG. 4.

Control of the image printing apparatus is realized when a CPU (not shown) serving as the controller of the present invention performs control operation and an arithmetic process on the basis of a control program stored in a ROM (not shown) to cooperate with the respective arrangements shown in FIG. 1 and FIG. 2A or 2B. The control system of the image printing apparatus according to the present invention comprises a system controller 101, read controller 102, image processor 103, convey driving controller 104, image printing controller 105, display operation controller 106, memory 107, and fixing controller 108.

The system controller 101 manages the respective controllers of the image printing apparatus to perform scheduling of requested image printing and the like.

The read controller 102 controls the operation of the image reading device YS. The image processor 103 performs an image process. The convey driving controller 104 controls the operation of a feed convey portion. The image printing controller 105 controls the operations of the image printing units 10Y, 10M, 10C, and 10K and the operation of an intermediate transfer body unit 6. The display operation controller 106 controls display and operation input reception of an operation display 106a. The memory 107 stores image data or the like.

Image printing of the image printing apparatus according to the present invention requires various conditions depending on the user.

The user can arbitrarily select paper (recording medium) to be set in the feed device. After setting paper in the feed device, the user registers the type of the paper (high-gloss coated paper or plain paper, the weight, and the like) in the main body controller. Whether or not the paper to be set is high-gloss coated paper may be discriminated and registered by the image printing apparatus, as will be described later. Coated paper includes low-gloss paper (mat-coated paper). Whether low-gloss paper is to be dealt with as either plain paper or high-gloss coated paper depends on the user selection.

Regarding the selection method as to what paper to supply, when the user selects either high-gloss coated paper or plain paper with the operation unit, the main body controller may select a feed device that matches the selected paper. Alternatively, the user may directly select from which feed device to output the paper with the operation unit.

When the user selects high-gloss coated paper other than maximum-size paper with the operation unit, the main body controller may select the first image printing mode. Even when the user selects high-gloss coated paper other than maximum-size paper with the operation unit, he may be able to select either the first image printing mode by giving priority to the image quality or the second image printing mode by giving priority to the productivity.

Conversely, even when the user selects plain paper other than maximum-size paper with the operation unit, he may be able to select either the first image printing mode by giving priority to the image quality or the second image printing mode by giving priority to the productivity. The image printing apparatus may make selection automatically on the basis of the document or input image data, as will be described later.

When image data is to be input from another device such as a personal computer, an image data input device selects the paper type, mode, and the like. Respective data selected together with the image data are input to the main body controller of the image printing apparatus. The main body controller controls the respective portions of the image printing apparatus on the basis of the input data.

The present invention includes an embodiment concerning an image printing apparatus having an automatic discrimination control system which discriminates the paper type or the like automatically, and an embodiment concerning an image printing apparatus having a manual control system to which the operator can input individual data with the operation unit in accordance with the object. These embodiments will be described with reference to FIGS. 5 and 6.

Figure 5:
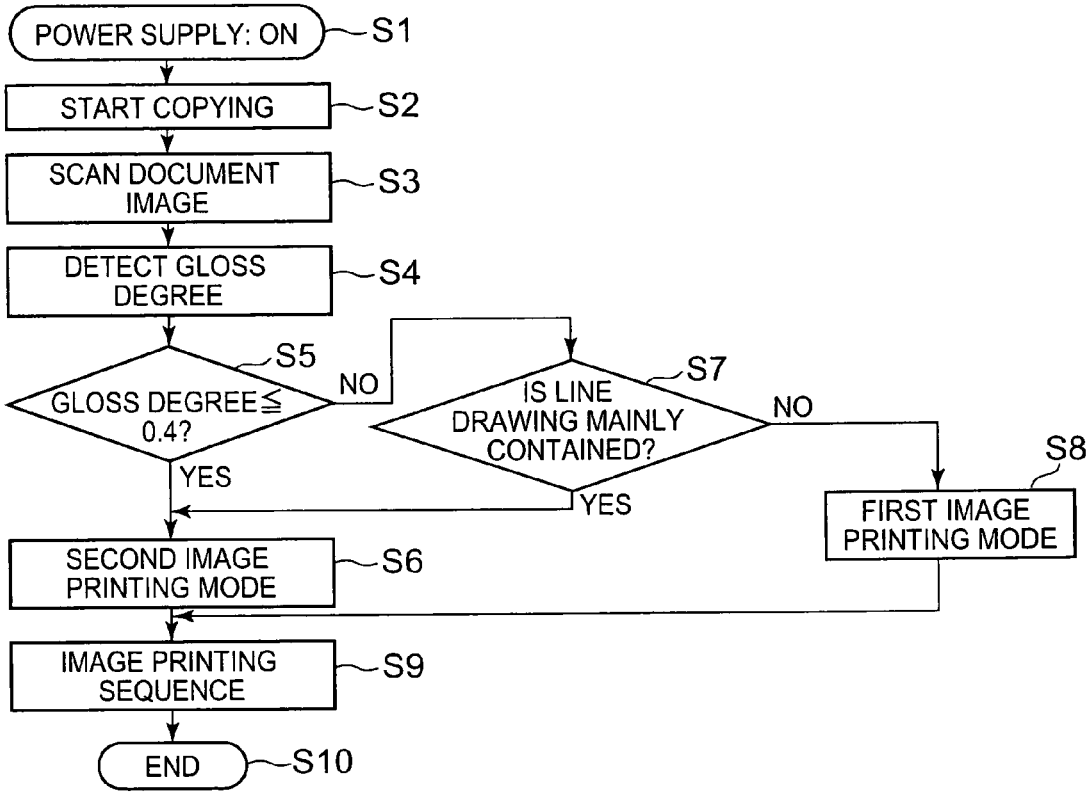
FIG. 5 is an operation flowchart of an image printing apparatus having an automatic discriminating function according to the present invention.

FIG. 5 is an operation flowchart of the image printing apparatus having the automatic discriminating function according to the present invention.

In the flowchart shown in FIG. 5, the power supply of the image printing apparatus is ON. Respective setting operations have been made at the display operation unit. The image printing apparatus is in a state of immediately before starting image reading.

An image D read by a line image sensor CCD is digitized by an A/D converter and sent as image information to a controller 101. The gloss degree of the document image is detected by a gloss level detection sensor PKa (see FIG. 1) used as a gloss level selector (step S4). For example, detection of the gloss level can be approximated by a value obtained by dividing a current value $i_2$ of a photosensor light-receiving portion L2 by a light-emission current value $i_1$ of a photosensor light-emitting portion L1. Generally, when $i_2/i_1$ is 0.4 or less, plain paper is used. When $i_2/i_1$ exceeds 0.4, high-gloss coated paper, film paper, or the like is used.

In the above manner, the CCD, the A/D converter, and the controller 101 constitute a detector that detects the type of the document image.

In step S5, whether or not the gloss degree approximated by b/a detected in step S4 is 0.4 or less is checked. If it is determined that b/a is 0.4 or less (YES in step S5), it is determined that plain paper is conveyed, and the process of step S6 is performed. If it is determined that b/a is not 0.4 or less (NO in step S5), it is determined that high-gloss coated paper is conveyed, and the process of step S7 is performed.

Whether the image mainly contains a photograph or picture, or a line drawing such as a character may be discriminated by using various types of known methods (e.g., Japanese Unexamined Patent Publication Nos. 5-62011, 5-344329, 5-344330, 7-30752, 8-251403, 2003-46771 and the like), or a riovel method. Whether or not the discrimination result is to be made effective depending on the type of paper to be supplied is arbitrary. More specifically, when plain paper is selected, the discrimination result may be canceled. When high-gloss coated paper is selected, the discrimination result may be made effective. In any case, if the user can select with the operation unit either the first image printing mode (step S8) or the second image printing mode (step S6) on the basis of the discrimination result, the user can enjoy the effect of the present invention when needed.

Figure 6:
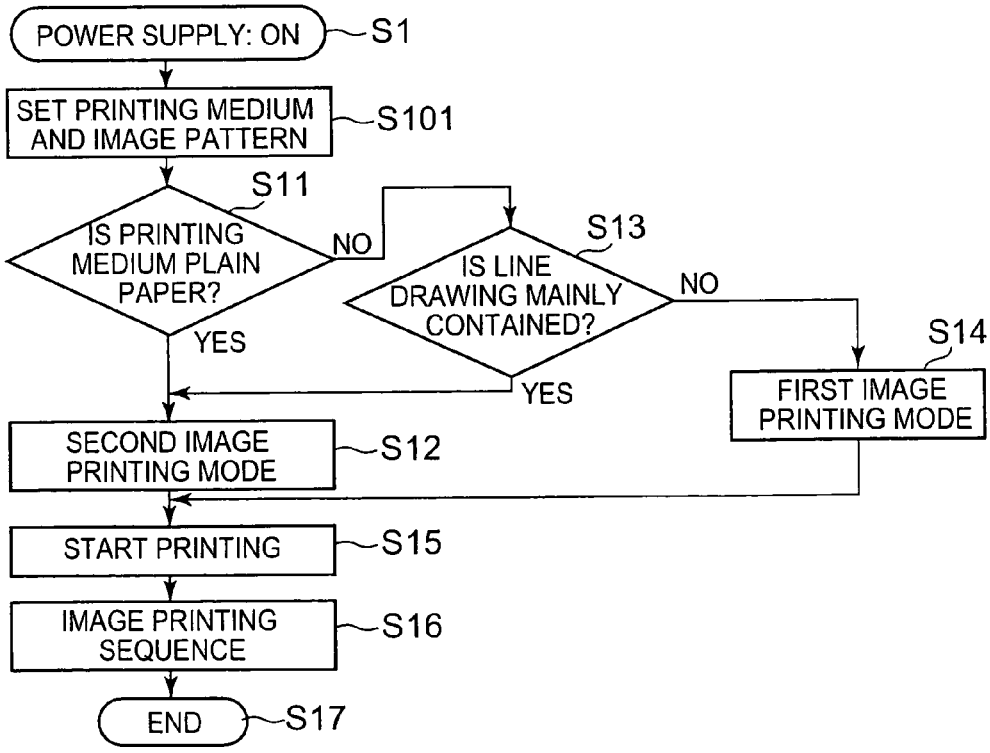
FIG. 6 is an operation flowchart of the image printing apparatus according to the present invention when manual operation is to be performed.
Figure 7:
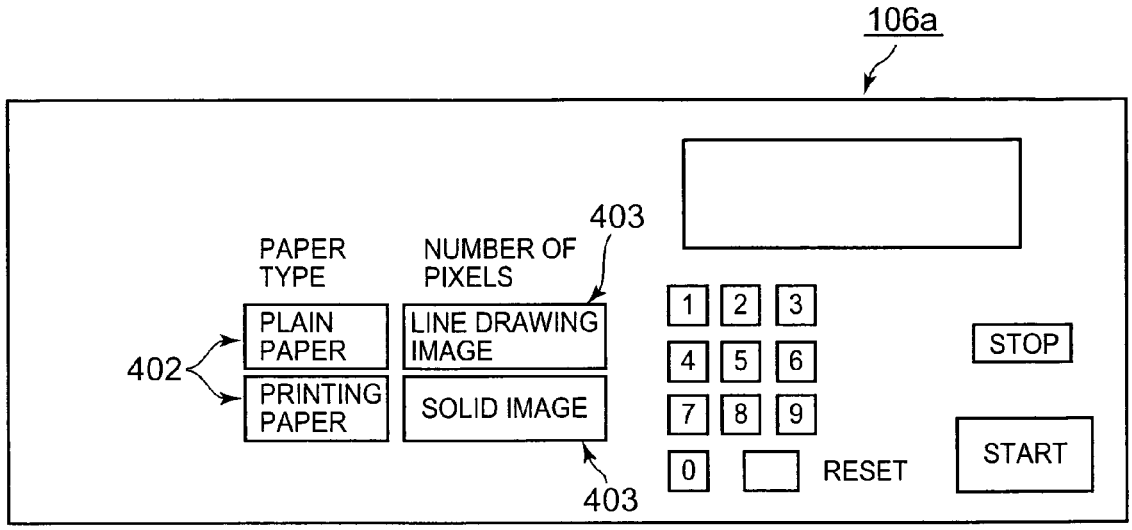
FIG. 7 is a view showing part of an operation display of the image printing apparatus according to the present invention.

FIG. 6 is an operation flowchart of the image printing apparatus according to the present invention when manual operation is to be performed. Various types of functions can be input from an operation display 106*a* shown in FIG. 7. FIG. 7 shows portions concerning the flowchart of FIG. 6, and the remaining portions are omitted.

As shown in FIG. 7, the operation display 106*a* comprises a touch panel and various types of operation buttons and has functions of making various types of guide displays and status displays for the user and accepting various types of operations from the user. The X- and Y-coordinates of a power point pushed by a finger, a dedicated touch pen, or the like, and button operation are detected. An operation signal as the detection result is output to the controller 101.

The display operation controller 106 (see FIG. 4) has paper type selection buttons 402 as an example of a recording medium setting portion and image pattern selection buttons 403 as an example of an image pattern setting portion. The user pushes the paper type selection buttons 402 to select and set a paper type, and the image pattern selection buttons 403 to select and set an image pattern.

In the flowchart shown in FIG. 6, first, the user sets the paper type of the recording medium and the image pattern by using the paper type selection buttons 402 and image pattern selection buttons 403 (step S101). Although a description is made on selection of the image pattern, selection may be made for either a high-gloss image or low-gloss image to be output.

In step S11, the recording medium is discriminated. If the recording medium is plain paper (YES in step S11), the process of step S12 is performed.

In step S11, if it is determined that the recording medium is not plain paper (for example, high-gloss coated paper is selected) (NO in step S11), it is checked whether or not the image mainly contains lines, that is, which one is selected between a line drawing and an image such as a photograph image containing many solid portions with the image pattern selection buttons 403 on the operation display 106*a* (step S13).

If the user selects a line drawing (YES in step S13), the process of step S12 is performed. If the user selects a solid image (NO in step S13), the process of step S14 is performed.

Various types of setting operations are performed with the operation display 106*a*. In step S15, print operation is started. Step S16 is an image printing sequence. In step S16, a normal image printing process is performed. The flow ends in step S17.

EXAMPLE

The fixing device shown in FIG. 2A is mounted in the image printing apparatus shown in FIG. 1, and an image is printed. The fixing gloss properties are checked visually. In the example, Konica Minolta copy paper NR-A80 (manufactured by Konica Minolta Business Technologies, Inc.) is used as plain paper, and POD 128-g/$m^2$ paper manufactured by Oji Paper is used as high-gloss coated paper. In this example, the maximum size of the paper (recording medium) was A3 (the recording medium has a length in convey direction of 420 mm×a width of 297 mm). The distance between the recording media is 50 mm. The circumferential length of the fixing belt is 524 mm which is longer than a sum (470 mm) of the length in convey direction of 420 mm of the recording medium and the distance between the recording media of 50 mm.

The fixing device 17-1 had the following arrangement.

| | |
|---|---|
| fixing belt 27: | |
| inner diameter | 165 mm |
| circumferential length | 524 mm |
| material of base | polyimide |
| thickness of base | 0.07 mm |
| thickness of elastic layer | 0.2 mm |
| material of elastic layer | silicone rubber |
| covered with 0.03-mm PFA tube | (30° in JIS-A hardness) |
| fixing roller 17a: | |
| outer diameter | 40 mm |
| material of base | carbon steel pipe for machine structure |
| outer diameter of base | 26 mm |
| thickness of elastic layer | 7 mm |
| material of elastic layer | silicone rubber (10° in JIS-A hardness) |
| heat roller 17c: | |
| outer diameter | 60 mm |
| material of base | aluminum pipe with PFA coating thickness of 10 μm |
| thickness of base | 3 mm |
| pressure roller 17b | |
| outer diameter | 50 mm |
| material of base | aluminum pipe |
| thickness of base | 2 mm |
| outer diameter of base | 46 mm |
| thickness of elastic layer | 2 mm |
| material of elastic layer | silicone rubber |
| covered with 3.05-mm PFA tube | (30° in JIS-A hardness) |
| system velocity: | 300 mm/sec |
| tight contact force of nip: | 900 N |

In the above example, the fixing quality of the plain paper is at such a level that the gloss difference is not noticeable.

With high-gloss coated paper, in the second image printing mode where a contact history portion (overlapping portion) with the belt occurs, a gloss difference is observed. In the first image printing mode where no overlapping occurs, no gloss difference is observed.

As described above, when the fixing device according to the present invention is used, a glossy printed result having a high fixing quality can be obtained with high-gloss coated paper. With plain paper which does not require a very high image quality and on which the gloss difference does not stand out, priority can be given to the productivity.

With the image printing apparatus according to the present invention, when the circumferential length of the fixing member is larger than the maximum recoding medium size, the contact history of a previous printing matter does not come into contact with the preceding recording medium (does not overlap). The image printing apparatus has a first image printing mode and a second image printing mode. In the first printing mode, the fixing member comes into contact with the recording medium at the same position during continual fixing operation. In the second image printing mode, the fixing member comes into contact with the recording medium with a time interval shorter than that in the first image printing mode. When the first image printing mode is selected, with a high-quality recording medium such as high-gloss coated paper, a glossy printing result having a high fixing quality can be obtained. When the second image printing mode is selected, with a standard size recording medium (such as A4-size plain paper) which is used often in an image printing apparatus, the recording medium is printed regardless of the contact position with the fixing member, thus improving the productivity.

With the image printing apparatus according to the another aspect, the image printing mode can be switched in accordance with the type of the recording medium. Thus, whether priority is to be given to the printing productivity or the fixing quality can be selected arbitrarily.

With the image printing apparatus according to the another aspect, whether the image pattern to be printed is a line drawing such as a character image or an image such as a photograph image with many solid regions can be selected by switching the image printing modes. Thus, whether priority is to be given to the printing productivity or the fixing quality can be selected arbitrarily.

What is claimed is:

1. An image printing apparatus comprising:

a fixing device which heats and fixes an unfixed toner image on a recording medium while sandwiching and conveying the recording medium by a heat member and a pressure member;

a first image printing mode where the recording medium comes into contact with said heat member at substantially the same position during continuous fixing operation; and a second image printing mode where the recording medium comes into contact with said heat member with a shorter time interval than in the first image recording mode.

2. An apparatus according to claim 1, wherein the first image printing mode and the second image printing mode are switched on the basis of a type of the recording medium.

3. An apparatus according to claim 1, wherein the first image printing mode and the second image printing mode are switched on the basis of an image pattern.

4. An apparatus according to claim 1, further comprising a type setting device to set a type of a recording medium, wherein the first image printing mode and the second image printing mode are switched on the basis of a type of a recording medium set by the setting device.

5. An apparatus according to claim 1, further comprising an image pattern setting portion, wherein the first image printing mode and the second image printing mode are switched on the basis of a preset image pattern.

6. An apparatus according to claim 4, further comprising an image pattern setting portion, wherein the first image printing mode and the second image printing mode are switched on the basis of a preset image pattern.

7. An apparatus according to claim 1, wherein in the first image printing mode, one turn of said heat member fixes one recording medium.

8. An apparatus according to claim 1, wherein in the second image printing mode, one turn of said heat member fixes more than one recording medium.

9. An apparatus according to claim 1, wherein said heat member comprises a roller.

10. An apparatus according to claim 1, wherein said heat member comprises a belt.

11. An apparatus according to claim 1, further comprising a detector which detects a type of the recording medium.

12. An apparatus according to claim 11, wherein said detector detects the type of the recording medium on the basis of a gloss degree of the recording medium.

13. An apparatus according to claim 1, wherein the circumferential length of a fixing member is larger than a sum of the length of the maximum-size recording medium and a distance between recording media during recording medium conveyance.

14. An apparatus according to claim 1, wherein said heat member has a circumferential length larger than a length of a maximum-size recording medium.

15. An image printing apparatus comprising:

a fixing device which heats and fixes an unfixed toner image on a recording medium while sandwiching and conveying the recording medium by a heat member and a pressure member, said heat member having a circumferential length larger than a length of a maximum-size recording medium;

a first image printing mode where the recording medium comes into contact with said heat member at substantially the same position during continuous fixing operation;

a second image printing mode where the recording medium comes into contact with said heat member with a shorter time interval than in the first image recording mode; and a switching device to switch the first image printing mode and the second image printing mode.

16. An apparatus according to claim 15, wherein the switching device switches first image printing mode and the second image printing mode on the basis of a type of the recording medium.

17. An apparatus according to claim 15, wherein the switching device switches the first image printing mode and the second image printing mode on the basis of an image pattern.

18. An image printing apparatus comprising:

a fixing device which heats and fixes an unfixed toner image on a recording medium while sandwiching and conveying the recording medium by a heat member and a pressure member;

a first image printing mode where each recording medium comes into contact with said heat member at substantially the same position each turn of the heat member during continuous fixing operation; and a second image printing mode where each recording medium comes into contact with said heat member at different positions between a turn and next turn of the heating member during continuous fixing operation.

19. An apparatus according to claim 18, further comprising a switching device to switch the first image printing mode and the second image printing mode.

20. An apparatus according to claim 18, wherein said heat member having a circumferential length larger than a length of a maximum-size recording medium.

21. An apparatus according to claim 18, wherein a switching device switches first image printing mode and the second image printing mode on the basis of a type of the recording medium.

22. An apparatus according to claim 18, wherein a switching device switches the first image printing mode and the second image printing mode on the basis of an image pattern.

23. An apparatus according to claim 18, wherein more than one recording medium come into contact with heating material every turn of the heating material in the first image printing mode.

24. An apparatus according to claim 18, wherein more than one recording medium come into contact with a heating material every turn of the heating material in the second image printing mode.

* * * * *